US005239712A

United States Patent [19]

Kinder

[11] Patent Number: 5,239,712

[45] Date of Patent: Aug. 31, 1993

[54] SHOWER FOR INDIVIDUAL WITH HAND DYSFUNCTION

[76] Inventor: Gregory V. Kinder, 375 Camel Pl., Billings, Mont. 59105

[21] Appl. No.: 974,175

[22] Filed: Nov. 10, 1992

[51] Int. Cl.[5] ..... A47K 7/06

[52] U.S. Cl. ..... 4/606; 15/21.1

[58] Field of Search ..... 4/604, 605, 606, 628, 4/525, 903; 15/21.1, 88.2

[56] References Cited

U.S. PATENT DOCUMENTS

| | | | |
|---|---|---|---|
| 3,042,949 | 7/1962 | Mosely | 15/21 |
| 3,091,776 | 6/1963 | Roberts | 4/606 |
| 4,704,756 | 11/1987 | Williams et al. | 15/21.1 |
| 4,854,499 | 8/1989 | Neuman | 236/93 B |
| 4,858,257 | 8/1989 | Bivens | 4/606 |
| 4,965,894 | 10/1990 | Baus | 4/605 |
| 4,967,935 | 11/1990 | Celest | 222/63 |

FOREIGN PATENT DOCUMENTS

| | | | |
|---|---|---|---|
| 2599614 | 12/1987 | France | 15/21.1 |
| 2061102 | 5/1981 | United Kingdom | 4/606 |

*Primary Examiner*—Henry J. Recla
*Assistant Examiner*—Charles R. Eloshway
*Attorney, Agent, or Firm*—Jacobson, Price, Holman & Stern

[57] ABSTRACT

A shower unit including an upper rotating disk pad, a lower oscillating brush assembly, two liquid soap spray nozzles, a constant temperature water valve and a shower head. The shower unit mounts to the wall of an existing shower stall, and may be constructed to suit the needs of particular individuals.

18 Claims, 2 Drawing Sheets

SHOWER FOR INDIVIDUAL WITH HAND DYSFUNCTION

BACKGROUND OF THE INVENTION

The present invention is directed to a shower unit for a person with no arms or with severe hand dysfunction.

Persons with severe physical disabilities have difficulties showering their bodies. Often, some of these persons need assistance from another person.

The present invention eliminates the need for personal assistance so that persons with no arms or with sever hand dysfunction may wash and shower themselves.

SUMMARY OF THE INVENTION

It is primary object of the present invention to provide an apparatus to permit a person with no arms or sever hand dysfunction to shower their body without personal assistance.

According to the present invention, a shower unit is provided which includes an upper rotating disk pad, a lower oscillating brush assembly, two liquid soap spray nozzles, a constant temperature water valve and a shower head. The shower unit mounts to the wall of an existing shower stall, and may be constructed to suit the needs of particular individuals.

The above and other objects and advantages of the present invention will become more readily apparent when reference is made to the following description taken in conjunction with the accompanying drawings.

DETAILED DESCRIPTION OF THE DRAWINGS

Figure 1:
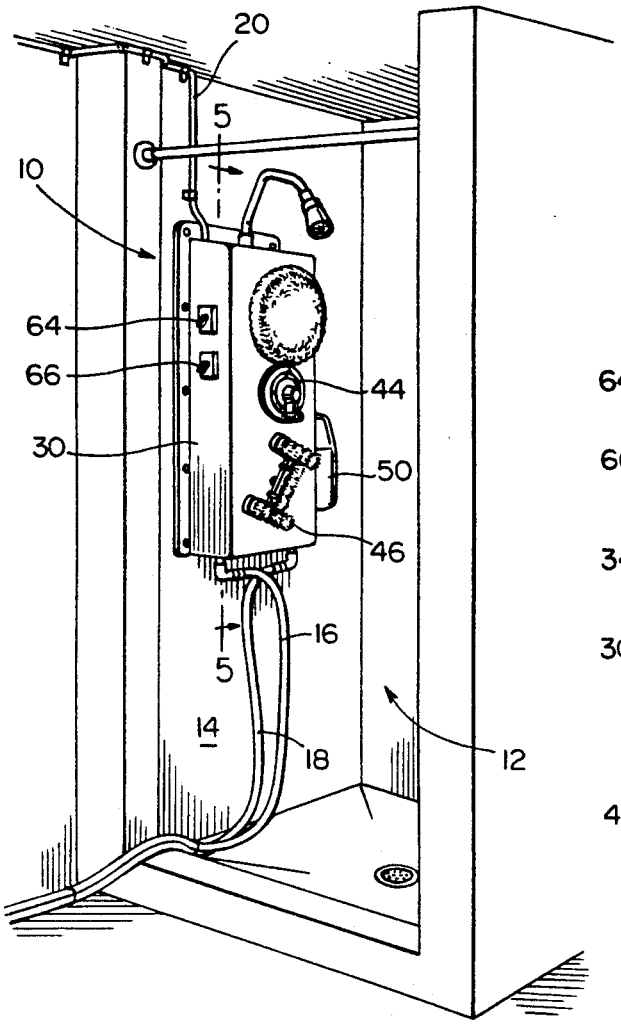
FIG. 1 is a perspective view of the shower unit mounted in a shower stall.
Figure 2:
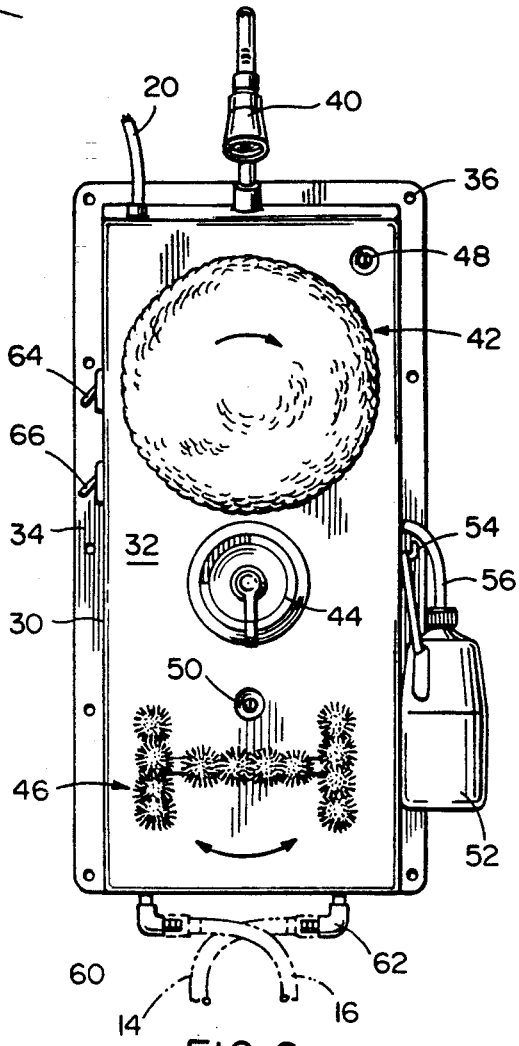
FIG. 2 is a front view of the shower unit according to the present invention.

Referring first to FIGS. 1 and 2, the shower unit according to the present invention is generally shown at 10. The shower unit 10 mounts in a shower stall 12 on a wall 14. It is connected to hot and cold water pipes 16 and 18 and a conventional household power supply line 20.

The unit 10 comprises an aluminum frame support assembly 30 having a face portion 32 and a peripheral mounting rim 34. The mounting rim 34 includes mounting holes 36 to screw or otherwise attach the shower unit into a shower stall.

On the shower unit 10 are a shower head 40, a rotating pad assembly 42, a water temperature control valve 44, an oscillating brush assembly 46 and top and bottom soap spray nozzles 48 and 50, respectively. A soap container 52 is attachable to the frame 30 by a hook 54. Soap is pumped by a pump (FIG. 4) through a pick-up tube 56 out of the soap container 52. Pipe connectors 60 and 62 are provided on the frame 30 to connect with the hot and cold water supply lines 14 and 16. Manual control of the rotating pad assembly, soap spray nozzles and oscillating brush assembly is made at the switches 64 and 66.

Figure 4:
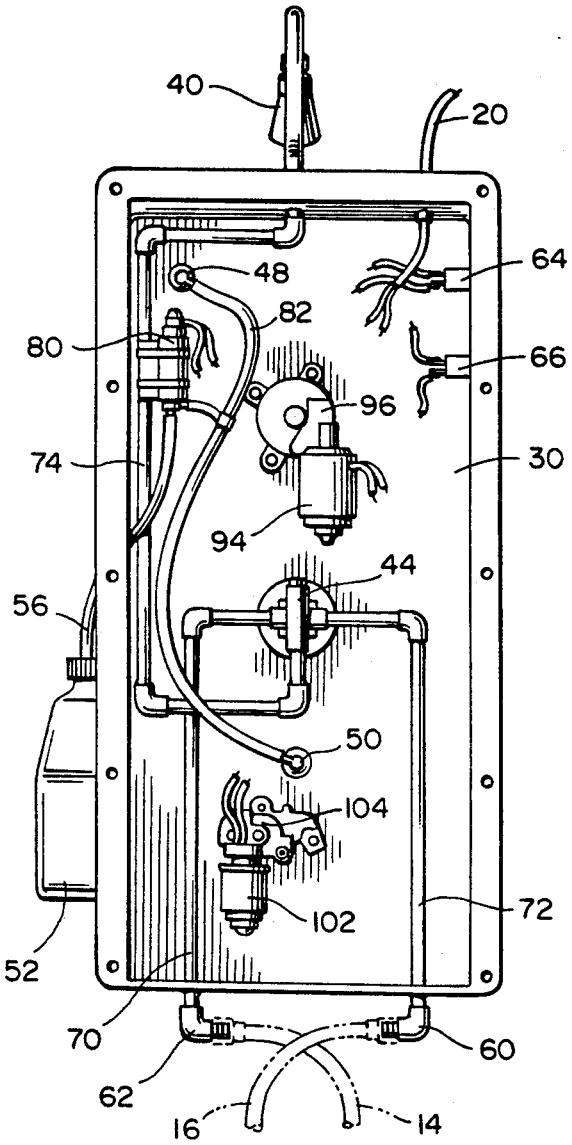
FIG. 4 is a rear view of the shower unit showing the electric motors, pipes and valves of the shower unit.
Figure 5:
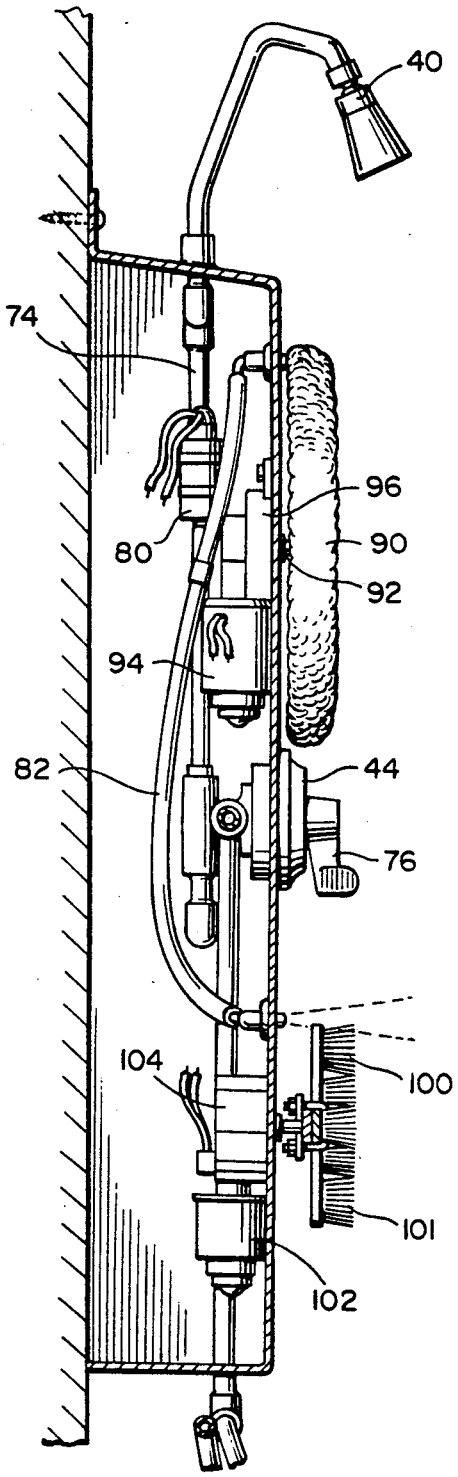
FIG. 5 is a sectional view of the shower unit taken along line 5—5 of FIG. 1.

Turning now to FIGS. 4 and 5, the internal components of the shower unit 10 will be described. The hot and cold water lines 14 and 16 are connected by pipes 70 and 72 to the water temperature control valve 44. This valve, which is well known in the art, is adjusted to set a desirable water temperature for the user of the shower unit. Once set at that water temperature, the water which passes through outgoing feed pipe 74 to the shower head 40, is within two degrees (typically) of that temperature. The user opens the valve by rotating the knob 76 through 180 degrees. This lets the constant temperature water flow into the outgoing pipe 74.

A soap pump 80 is mounted inside the frame, for example on the pipe 74, and is connected to the soap container 52 by the pick-up tube 56. The soap pump 80 pumps soap out of the container 52 and supplies the soap to the outgoing tube 82 which feeds the spray nozzles 48 and 50. Soap is emitted under pressure from the spray nozzles 48 and 50 outward from the frame support assembly 30.

The rotating pad assembly 42 includes a generally circular soft scrubber pad 90 having a generally flat surface for engaging anatomical surfaces and which is mounted to rotate about an axle 92. A motor 94 is mounted on the frame 30 and drives the pad 90 through a transmission element 96. The transmission element 96 converts the rotation of the motor about a vertical axis to rotation about a horizontal axis.

Similarly, the oscillating brush assembly 46 includes a brush 100 driven by an electric motor 102 mounted on the frame 30. The brush 100 is generally u-shaped and has bristles 101 extending outward. A transmission element 104 is provided to impart an oscillating motion to the brush 100.

The rotating pad assembly 42 cleans surfaces of the body of a user by making rotating contact with anatomical surfaces of the body. The pad 90 engages these surfaces and scrubs away dirt. The oscillating brush assembly cleans surfaces and other areas difficult to reach with a flat pad by scrubbing in an oscillatory manner surfaces of the body. In this regard, the oscillating brush more aggressively cleans the body of the user.

Elements 96 and 104 are well known in the art and are therefore not shown or described in detail.

Figure 3:
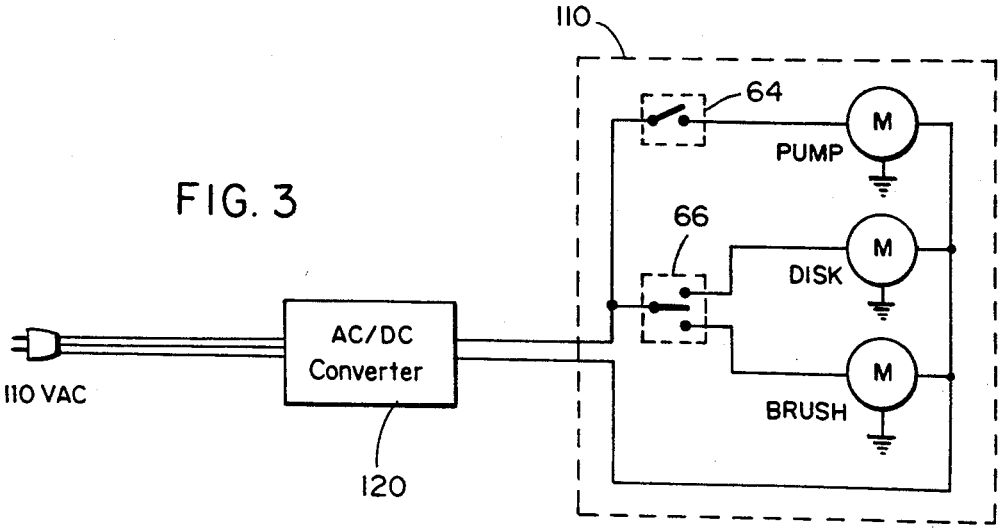
FIG. 3 is a schematic diagram of the electrical circuit driving the shower unit.

Actuation of the pump 80 and the motors 94 and 100 are controlled by the switches 64 and 66. With reference to FIG. 3, the switches 64 and 66 are connected in a circuit 110 with the pump 80 and motors 94 and 102. The conventional household power supply of 110 VAC is converted to DC voltage by an AC/DC converter 120. The DC voltage is supplied to the pump under control of switch 64. Switch 64 has two positions, open or closed. When open, no voltage is supplied to the pump and it remains off. When closed, voltage is supplied to the pump which in turn sucks soap out of the soap container and supplies the soap to the spray nozzles 48 and 50.

Switch 66 has three operative positions. When positioned to its upper position, the motor 94 is energized to rotate the disk pad 90. When positioned in its lower position, the motor 102 is energized to rotate the brush 100. The middle position of switch 66 is an off position for both motors 94 and 102.

The shower unit 10 is designed for use by persons with no hands or sever hand dysfunction. Installation of the shower unit 10 is achieved by mounting the frame 30 to a wall of a shower stall by inserting screws through the mounting holes 36. The hot and cold water lines are connected to the pipe connectors 60 and 62. In addition, the power line 20 is properly connected to the circuit as shown in FIG. 3. Prior to first use, the water temperature for the particular user is set on the water valve 44 to the water temperature most comfortable to the particular user.

Once properly installed, a user opens the water valve by rotating the knob 76 with his/her knee, shoulder or stub of the shoulder. Similarly, the switches 64 and 66 are actuated by the user's shoulder stubs, etc, to operate the soap spray and motors 94 and 100.

It is to be understood that the specific structure of the shower unit may be designed to suit persons with different physical handicaps. For example, the switches 64 and 66 may be positioned either higher or lower on the frame support assembly 30. The switches 64 and 66 may be push-button switches, or any other type which may be more suitable for the user. Moreover, the switches could be connected in a circuit arrangement different than the one shown in FIG. 3, so that different switch positions control the motors in a manner different from that described above. The water valve may be adjustable to different water temperatures for persons physically able to adjust the temperature of the water.

The above description is intended by way of example only and is not intended to limit the present invention in any way except as set forth in the following claims.

I claim:

1. A shower unit for use by individuals with hand dysfunction, the shower unit comprising:

frame support means having a face portion in front of which a user stands;

a shower head for supplying the water under pressure onto a user;

water valve means capable of being opened and closed by the user for supplying water to the shower head;

rotary brush means mounted on the face portion of the frame support means for rotating and making contact with the user;

reciprocating brush means mounted on the face portion of the frame support means for reciprocating and making contact with the user;

soap spray nozzles provided on the frame support means for spraying soap onto the user;

pump means for supplying soap to the soap spray nozzles;

electric motor means for driving the rotary brush means and for driving the reciprocating brush means;

switch means for controlling the pump means and for controlling the motor means, and capable of being actuated by the user.

2. The shower unit of claim 1, and further including connecting means for connecting to hot and cold water supply lines.

3. The shower unit of claim 2, wherein the water valve means is a constant temperature water valve and is connected to the connecting means, the water valve means capable of being set to a fixed temperature for supplying water at a substantially constant temperature to the shower head.

4. The shower unit of claim 3, wherein the water valve means comprises an actuating knob capable of being rotated in one direction to open the water valve means and being rotated in an opposite direction to close the water valve means.

5. The shower unit of claim 1, wherein the switch means comprises first and second switches, the first switch for controlling the pump means and the second switch for controlling the motor means.

6. The shower unit of claim 5, wherein the first and second switches are mounted on the frame support means, the first switch having first and second operative positions for energizing and de-energizing, respectively, the pump means.

7. The shower unit of claim 1, wherein the motor means comprises first and second electric motors, the first electric motor for driving the rotating brush means and the second electric motor for driving the reciprocating brush means.

8. The shower unit of claim 7, wherein the switch means comprises first and second switches, the first switch for controlling the pump means and the second switch for controlling the first and second electric motors.

9. The shower unit of claim 8, wherein the second switch comprises three operative positions, a first position for energizing the first electric motor, a second position for de-energizing the first and second electric motors, and a third position for energizing the second electric motor.

10. The shower unit of claim 9, wherein the rotating brush means is mounted on the frame support means vertically above the reciprocating brush means, the first position of the second switch being vertically above the second switch position, and the second switch position being vertically above the third switch position.

11. The shower unit of claim 1, and further comprising electric power line means for connecting to a household alternating current power supply, and AC-to-DC conversion means connected between the alternating current power supply and the switch means.

12. The shower unit of claim 1, and further comprising soap container means, means for attaching the soap container means to the frame support means, and a pick-up line connected between the soap container means and the pump means.

13. The shower unit of claim 1, and further comprising mounting holes in the frame support means for attaching the shower unit to a wall of a shower stall.

14. In a shower unit including a shower head, water supply means and control valve means controlling flow of water from the supply means to the shower head, the improvement comprising brush means, means movably supporting said brush means in a position for engagement by anatomical surfaces of a shower user, power means connected to said brush means for moving said brush means in relation to the anatomical surfaces of a user to clean the anatomical surfaces engaged with said brush means, said brush means includes a rotary brush means and oscillatable brush means oriented in spaced relation to the rotary brush means to engage different anatomical surfaces.

15. The improvement as defined in claim 14, wherein the rotary brush means includes a generally circular pad having a generally flat, vertically oriented surface for engaging anatomical surfaces, said means supporting said rotary brush means including a vertical support member and a horizontal shaft journalled on said support member, said power means including a motor connected with said shaft, and manually operated control means for said motor.

16. The improvement as defined in claim 14, wherein said oscillatable brush means includes a generally H-shaped brush oriented vertically with horizontal bristles extending toward a user for engaging anatomical surfaces, said means supporting said oscillatable brush means including a vertical support member and a horizontal shaft journalled on said support member, said power means including a motor having an oscillatable output connected to said shaft, and manual control means for said motor.

17. The improvement as defined in claim 15, wherein said oscillatable brush means includes a generally H-shaped brush oriented vertically with horizontal bristles extending toward a user for engaging anatomical surfaces, said means supporting said oscillatable brush means including a vertical support member and a horizontal shaft journalled on said support member, said power means including a motor having an oscillatable output connected to said shaft, an manual control means for said motor and; said pad being disposed vertically above and generally aligned with said H-shaped brush, said motor being an electric motor and said motor control means being an electric switch mounted on said support member.

18. The improvement as defined in claim 17, together with dispensing means for cleaning solution adjacent each of said pad and said H-shaped brush for discharging cleaning solution onto anatomical surfaces being cleaned by engagement with said pad and brush.

* * * * *